United States Patent [19]

Matsubara

[11] Patent Number: 4,657,176

[45] Date of Patent: Apr. 14, 1987

[54] COLLAPSIBLE BOX INCLUDING BAG AND ATTACHED LID

[75] Inventor: Izuru Matsubara, Osaka, Japan

[73] Assignee: Eiwa Sangyo Kabushiki Kaisha, Osaka, Japan

[21] Appl. No.: 801,314

[22] Filed: Nov. 25, 1985

[51] Int. Cl.[4] ..... B65D 30/00

[52] U.S. Cl. ..... 229/41 R; 220/1 T; 229/45 R; 229/907

[58] Field of Search ..... 229/41 R, 41 B, 43, 229/45 R, 117, 907, 185; 220/1 T; 248/318, 205.3; 206/806; 383/11

[56] References Cited

U.S. PATENT DOCUMENTS

| | | | |
|---|---|---|---|
| 393,899 | 12/1888 | Haines | 229/43 |
| 2,595,678 | 5/1952 | Levkoff | 29/43 |
| 2,900,122 | 8/1959 | Steiner | 229/185 |
| 3,568,917 | 3/1971 | Vergobbi | 229/43 |
| 3,589,595 | 6/1971 | White | 383/11 |
| 3,901,432 | 8/1975 | Lancaster | 229/45 R |
| 4,402,452 | 9/1983 | Kupersmit | 229/45 R |
| 4,470,523 | 9/1984 | Spector | 248/205.3 |
| 4,570,845 | 2/1986 | Hall | 229/45 R |

FOREIGN PATENT DOCUMENTS

| | | | |
|---|---|---|---|
| 59-193114 | 12/1984 | Japan | 229/41 R |
| 60-123326 | 8/1985 | Japan | 229/41 R |
| 102218 | 3/1963 | Norway | 229/DIG. 14 |

*Primary Examiner*—William Price
*Assistant Examiner*—Gary E. Elkins
*Attorney, Agent, or Firm*—Parkhurst & Oliff

[57] ABSTRACT

A simplified and foldable disposable rubbish box characterized in that a square-shaped upper lid having an opening thereon is provided with folding flaps on the edges of the upper lid, a pair of folding flaps opposing to each other (hereinafter referred to as "the one opposing folding flaps") are so formed that they contact inner walls near the upper opening of a square-bottomed bag while the other pair of folding flaps opposing to each other (hereinafter referred to as "the other opposing folding flaps") are stuck to the inner wall near upper opening of the square-bottomed bag in a manner such that folding lines of the folding flaps are positioned slightly above the open end of the square-bottomed bag. The one opposing flaps have a folding line which crosses in the middle thereof along the line crossing the center of the opening provided on the upper lid, and projections are provided on the both sides of each of the one opposing folding flaps which engages with holes provided on the square-bottomed bag at corresponding positions for receiving the projections.

5 Claims, 9 Drawing Figures

COLLAPSIBLE BOX INCLUDING BAG AND ATTACHED LID

BACKGROUND OF THE INVENTION

The present invention relates to a simplified and foldable box into which dust, rubbish and wasted matters are disposed.

As a container for getting dust, rubbish and wasted matters, a rubbish box, trash box, etc. are known. Rubbish boxes and baskets have been made of wood and bines of wood respectively. Recently, containers made from plastics have been used as such a box. However, this is merely a variation of the material of the conventional rubbish box and so on by using plastics.

Nowadays, throwaway or one-way articles have been broadly used, so that throwaway rubbish box and so on are desired. So far, there have been few known simple boxes for placement in rubbish box and the like although plastic bags made from polyethylene, etc. or paper bags have been employed as a means for housing rubbish, etc., in a rubbish box.

SUMMARY OF THE INVENTION

The present invention has its object to provide a simplified and foldable box for receiving dust, rubbish and other wasted matter, which is made of paper, a plastic sheet, etc. and can be easily formed into a container.

Another object of the present invention is to provide a simplified and foldable box made from inexpensive materials such as paper, thick paper, a plastic sheet, etc., and which can be thrown away keeping rubbish and wasted matters therein.

Another object of the present invention is to provide a simplified and foldable box which is self-standable or can be stuck to a desk or to wall of a room by means of an adhesive applied on an outer wall face of the container, if desired.

DETAILED DESCRIPTION OF THE DRAWINGS

DETAILED DESCRIPTION OF THE INVENTION

Figure 1:
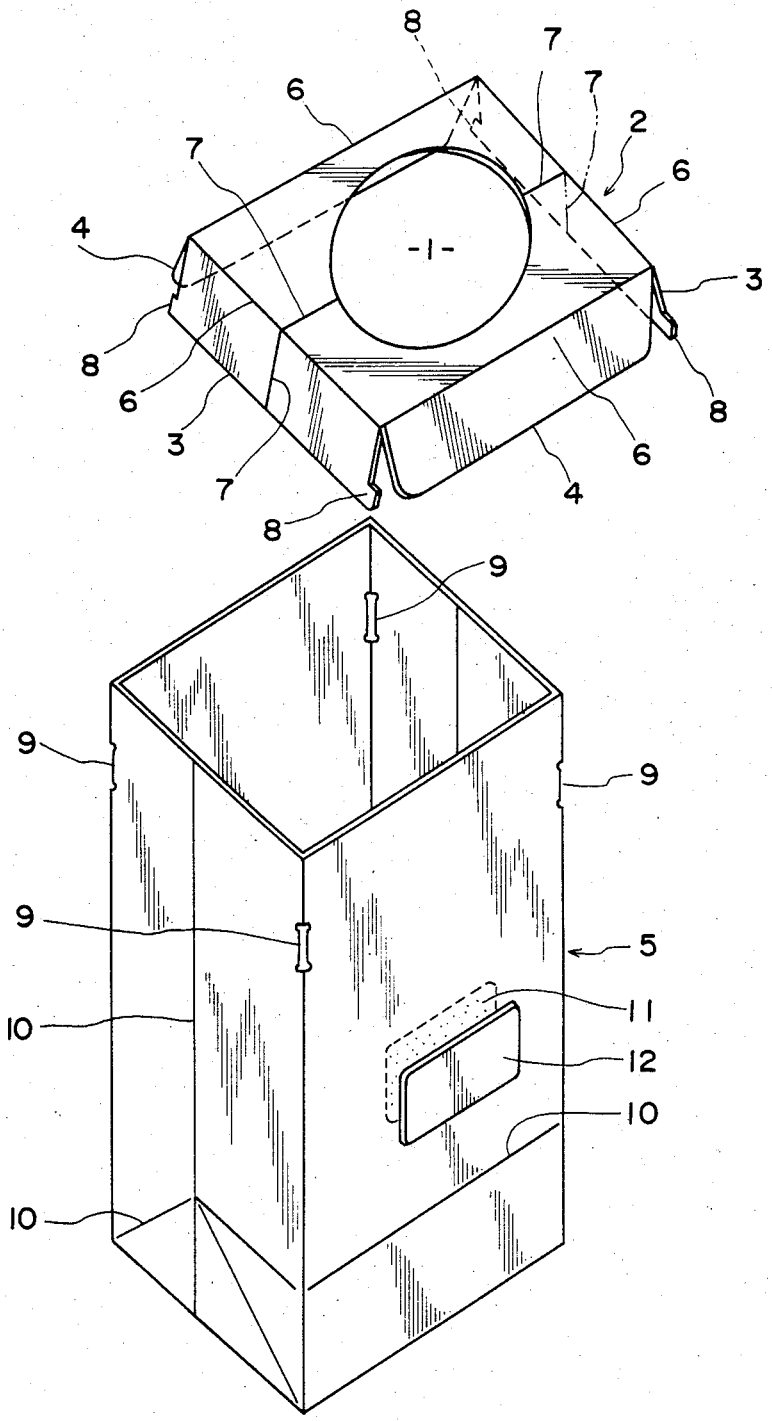
FIG. 1 is a perspective view of one preferred embodiment according to the present invention in which an upper lid and a square-bottomed bag are not assembled.

A simplified and foldable box according to the present invention is characterized in that a square-shaped upper lid having an opening thereon is provided with folding flaps on the edges of the upper lid, a pair of folding flaps opposing to each other (hereinafter referred to as "the one opposing folding flaps") are so formed that they get into contact with the inner walls near the upper opening of a square-bottomed bag while the other pair of folding flaps opposing to each other (hereinafter referred to as "the other opposing folding flaps") are stuck to the inner wall near upper opening of the square-bottomed bag in a manner that folding lines of the folding flaps are positioned slightly above the open end of the square-bottomed bag. The one opposing folding flaps have a folding line which crosses in the middle thereof along the line crossing the center of the opening provided on the upper lid, and projections are provided on both sides of each of the one opposing folding flaps, which engage with holes provided on the square-bottomed bag at corresponding positions for receiving the projections.

The simplified and foldable box of the present invention is not one in which an upper opening of the square-bottomed bag is merely sticked with an upper lid having an opening through which dust, rubbish, wasted matters, etc. are put, but has the following improvements:

First, when the simplified and foldable box which is folded is expanded, the box is arranged to expand into square surely and easily by sticking the folding flaps to the square-bottomed bag at such position that the folding lines of the folding flaps are positioned slightly above the open end of the square-bottomed bag, whereby the movement of the lower ends of the side portions of the folding flaps toward the outer position is delayed from that of the open end of the square-bottomed bag toward the outer position.

Secondly, projections are provided on both sides of the folding flaps and holes which engage the projections are provided in the square-bottomed bag at positions corresponding to the projections so as to make the expansion stable.

Moreover, an adhesive may be applied to a part of the side walls of the box. The adhesive-applied portion may be covered with a removeable paper. In use, the paper is peeled off so as to apply the box to a wall, face of a desk and so on. In this connection, the adhesive may also be applied to the bottom of the box.

In the simplified and foldable box of the present invention, both the upper lid and square-bottomed bag are made of a thick paper or plastic sheet; Alternatively, only the upper lid is made of thick paper or plastic sheet while the square-bottomed bag is made of paper, laminated paper, etc. The materials composing the square-bottomed bag may be selectively used according to the object in use, examples of which are kraft paper, polyethylene-laminated paper, aluminum foil-laminated paper, aluminum foil-plastic film-laminated paper, etc.

Now, one of the embodiments of the present invention will be explained with reference to FIGS. 1–3.

Figure 2:
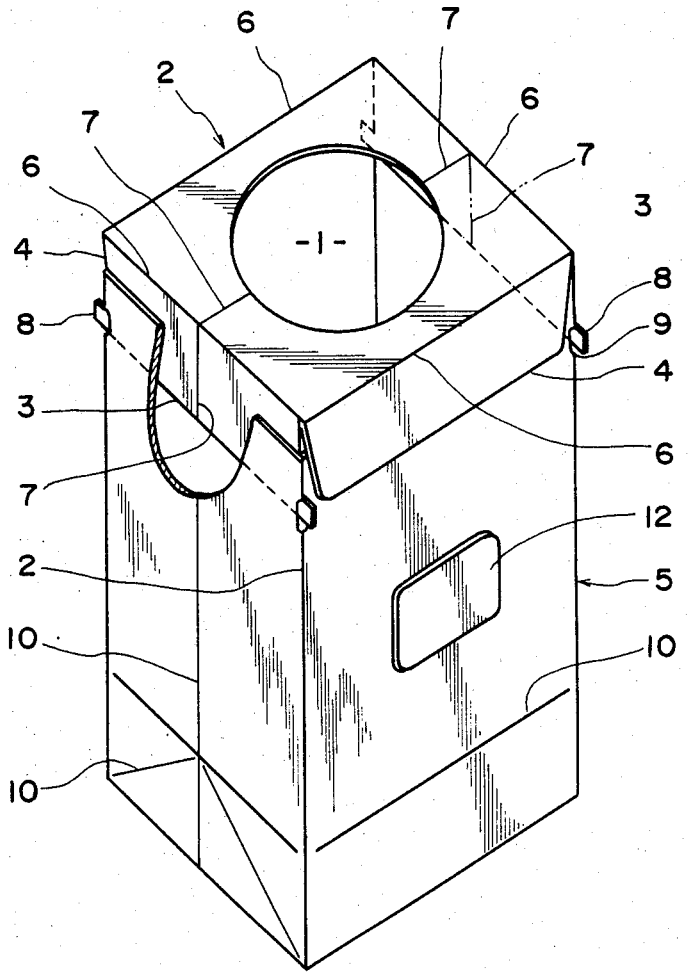
FIG. 2 is a perspective view of a simplified and foldable box illustrated in FIG. 1 after being assembled.

FIG. 1 is a perspective view showing a state of the present invention before an upper lid and a square-bottomed bag of the present invention are joined; and FIG. 2 is a perspective view showing a state of use of the present invention. As shown in these drawings, an opening 1 is provided on a square-shaped upper lid 2 made, for example, of pasteboard and all sides of the upper lid 2 are provided with folding flaps 3,4. The one opposing folding flaps 3 are so formed that they can be brought into contact with the inner walls near the upper opening of a square-bottomed bag 5 which has a firm stand and is self-standable. On the other hand, the other opposing folding flaps 4 are stuck to the outer wall faces of the upper opening of the square-bottomed bag in a manner that folding lines 6 provided on the folding flaps 4 are positioned slightly above, by about 5 to 10 mm, the open end of the square-bottomed bag 5. The one opposing folding flaps 3 are provided with a folding line 7 which crosses in the middle thereof along the line crossing the center of the opening 1. Projections 8 protruding outwardly are formed at the lower end of the both sides of the folding flaps 3 and holes 9 which engage with the projections 8 are provided in the square-bottomed bag 5 at position corresponding to said projections 8. Reference numerals 10 are folding lines of the square-bottomed bag.

In the drawings, reference numeral 11 is an adhesive and reference numeral 12 is a removeable paper which covers the face of the adhesive 11. The application of the adhesive 12 may only be used if needed. The application of the adhesive may be directly applied to the box. Alternatively, double-faced adhesive tape may be used. The adhesive is adhesion-adhesive or pressure-sensitive adhesive.

Figure 3:
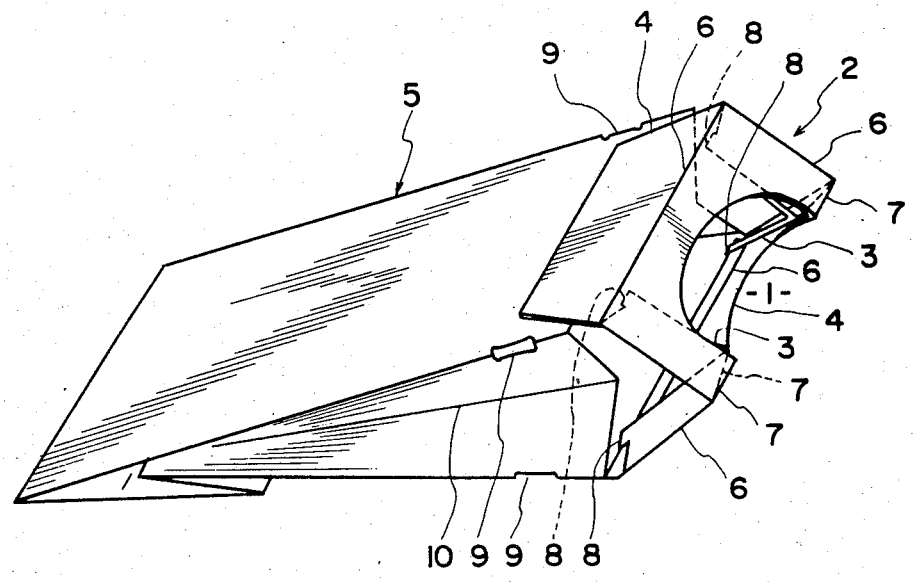
FIG. 3 is a perspective view of a simplified and foldable box illustrated in FIG. 2 being folded.
Figure 4:
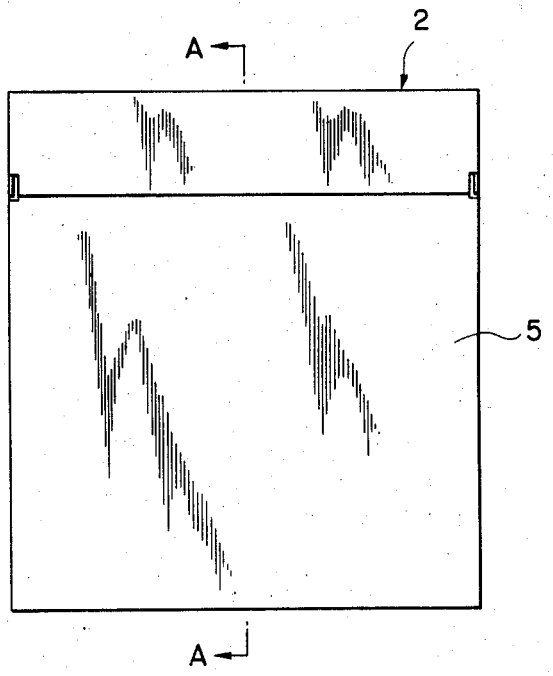
FIG. 4 is a front elevational view of another embodiment of the present invention.
Figure 5:
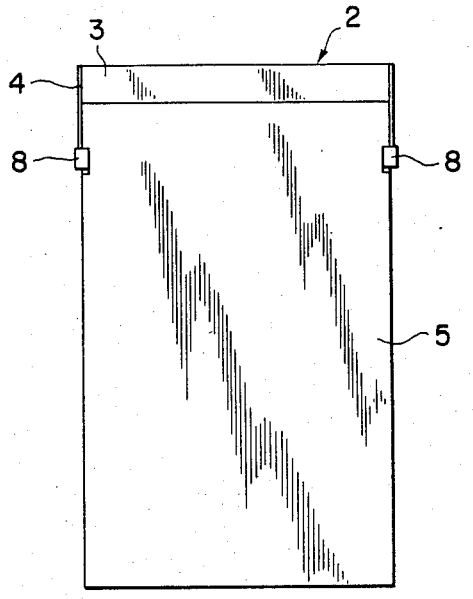
FIG. 5 is a side elevational view of a simplified and foldable box illustrated in FIG. 4.
Figure 6:
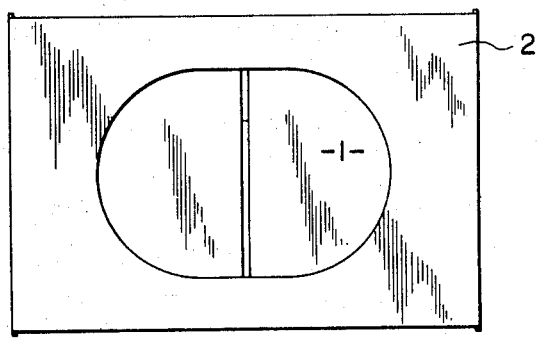
FIG. 6 is a top plan view of the box of FIG. 4.
Figure 7:
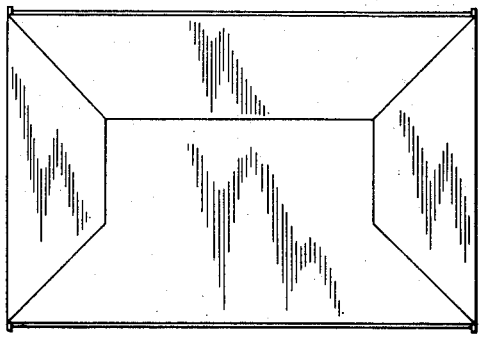
FIG. 7 is a bottom view of the box of FIG. 4.
Figure 8:
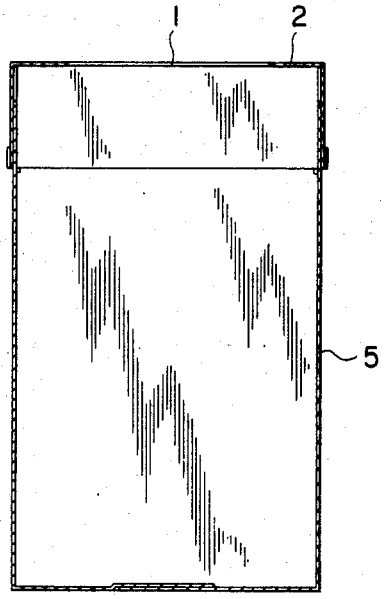
FIG. 8 is a cross-sectional view taken along the line of A—A.
Figure 9:
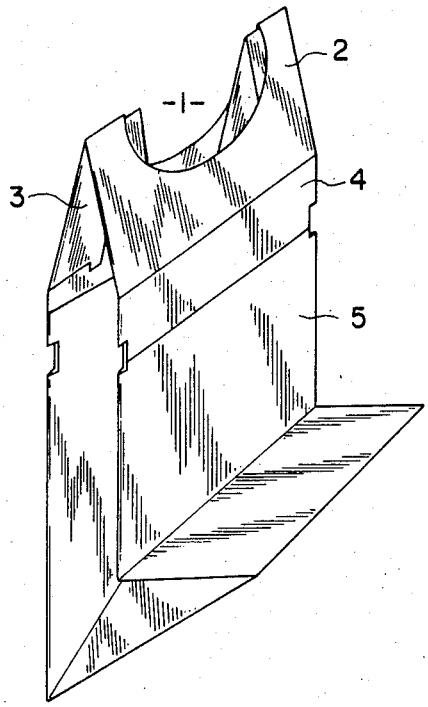
FIG. 9 is a perspective view of the box in FIG. 4 being folded.

FIG. 3 shows a state that the simplified and foldable box is in after the folding of lines 7 of the upper lid 2. In use of the simplified and foldable box, as shown in FIG. 2, it is made to be self-standing by expanding the square-bottomed bag 5, expanding the folded upper lid 2 into a plan state to stand the one opening folding flaps 3 vertically and inserting the projections 8 of the folding flaps 3 into the holes 9 of the square-bottomed bag 5.

As described above, the present invention is a simplified and foldable box having such a construction that folding flaps are formed around the square-shaped upper lid having an opening thereon; the one opposing folding flaps are arranged to be brought into contact with the the inner wall of the upper opening of the square-bottomed bag while the other opposing folding flaps are stuck to the wall face of the upper opening of the square-bottomed bag in such a manner that the folding lines of the other opposing folding flaps are positioned slightly above the open end of the square-bottomed bag; the one opposing folding flaps are provided with a folding line which crosses in the middle thereof along the line crossing the opening of the upper lid; projections are provided at the sides of the one opposing folding flaps as well as holes which engage with the projections are provided in the square-bottomed bag at positions corresponding to the projections. The upper lid can be easily put on the square-bottomed bag. Accordingly, the present invention can be produced inexpensively and can be utilized as a throw-away rubbish box. Moreover, the present invention can be folded into a shape of a sheet, it is not bulky nor takes much space, thereby resulting in convenience for transportation and storage. Furthermore, the present invention can be suitably finished by, for example, painting the upper lid a different color and using the invention as an interior article. In addition, the present invention can be readily fabricated in use by one-touch operation, i.e., expanding the upper lid into a plan shape so as to raise the folding flaps vertically.

As, the folding lines of the folding flaps are stuck to the square-bottomed bag at the position slightly above the open end of the wall face of the square-bottomed bag; thus when the simplified and foldable box is expanded, the box is steadily and easily expanded into square shape due to this construction so that the movement of the lower end of the side portions of the folding flaps having no adhesive toward the outer position is delayed from that of the open end of the square-bottomed bag toward the outer position. Therefore, the folding flaps are surely brought into contact with the inner wall of the upper opening of the square-bottomed bag from the inside and the folding flaps are not positioned outside of the wall face of the upper opening of the square-bottomed bag at all.

Moreover, as the projections are provided on the sides of the folding flaps and the holes which engage with the projections are provided in the square-bottomed bag at positions corresponding to the projections, the simplified and foldable box is easily expanded into a square shape and is held securely by inserting the projections into the holes.

FIGS. 4 to 9 show another embodiment of the present invention which is same with the aforementioned embodiment except that an opening of the upper lid is ellipse and an adhesive is not used. Accordingly, the respective reference numerals in the drawings are the same as used in FIGS. 1 to 3.

In the present invention, a modification may be applied wherein the open end of the square-bottomed bag is arranged in a manner such that the upper edges of the wall faces on the sides of the other opposing folding flaps are lower than the upper edges of the wall faces on the side of the one opposing folding flaps so as to ensure that the folding lines of the one opposing folding flaps of the upper lid than are higher than the folding lines of the other folding flaps.

What is claimed is:

1. A simplified and foldable box comprising a square-shaped upper lid having an opening thereon and provided with opposed folding flaps connected along folding lines on edges of the upper lid, a first pair of said opposing flaps so formed that they contact with inner surfaces near an opening of a square-bottomed bag while a second pair of said opposing folding flaps contact outer surfaces near the opening of the square-bottomed bag, wherein the folding lines of the folding flaps are positioned slightly above the open end of the square-bottomed bag, the first pair of opposing flaps having a folding line which crosses in the middle of said first pair of opposing folding flaps and along a line crossing the center of the opening provided on the upper lid means associated with said bag for permitting said bag and said lid to collapse as a unit, projections on both sides of each of said first pair of opposing folding flaps, said projections engaging holes on the square-bottomed bag located so as to receive the projections.

2. A simplified and foldable box as claimed in claim 1, wherein an adhesive is applied to a part of an external side wall of the box and a released paper is applied on an outer face of said adhesive.

3. A simplified and foldable box as claimed in claim 1, wherein said opening of said square-bottomed bag is arranged such that the height of said second pair of foldable flaps is lower than said first pair of opposing foldable flaps.

4. A simplified and foldable box as claimed in claim 1, wherein said upper lid is made of pasteboard or a plastic sheet, and said square-bottomed bag is made of paper or laminated sheet.

5. A simplified and foldable box as claimed in claim 1, wherein said box is a rubbish box.

* * * * *